US009964108B2

(12) United States Patent
Lo Biundo et al.

(10) Patent No.: US 9,964,108 B2
(45) Date of Patent: May 8, 2018

(54) VARIABLE DISPLACEMENT OIL PUMP

(71) Applicant: O.M.P. OFFICINE MAZZOCCO PAGNONI S.R.L., Funo (BO) (IT)

(72) Inventors: Giuseppe Lo Biundo, Partinico (IT); Alessandra De Rango, Granarolo Emilia (IT)

(73) Assignee: O.M.P. OFFICINE MAZZOCCO PAGNONI S.R.L., Funo (BO) (IT)

( * ) Notice: Subject to any disclaimer, the term of this patent is extended or adjusted under 35 U.S.C. 154(b) by 0 days. days.

(21) Appl. No.: 15/531,409

(22) PCT Filed: Dec. 3, 2015

(86) PCT No.: PCT/IB2015/059329
§ 371 (c)(1),
(2) Date: May 26, 2017

(87) PCT Pub. No.: WO2016/088077
PCT Pub. Date: Jun. 9, 2016

(65) Prior Publication Data

US 2017/0328365 A1 Nov. 16, 2017

(30) Foreign Application Priority Data

Dec. 5, 2014 (IT) ..... MI2014A2090

(51) Int. Cl.
*F03C 4/00* (2006.01)
*F04C 2/00* (2006.01)
(Continued)

(52) U.S. Cl.
CPC ..... *F04C 14/22* (2013.01); *F01C 21/106* (2013.01); *F04C 2/344* (2013.01); *F04C 14/226* (2013.01);
(Continued)

(58) Field of Classification Search
CPC ..... F04C 14/22; F04C 14/223; F04C 14/226; F04C 15/003; F04C 2/344;
(Continued)

(56) References Cited

U.S. PATENT DOCUMENTS 4,531,893 A * 7/1985 Okoh ..... F04C 14/226 418/30
2007/0224067 A1* 9/2007 Arnold ..... F04C 14/226 418/30
(Continued)

FOREIGN PATENT DOCUMENTS

EP 1820935 A1 8/2007
JP 2000104671 A 4/2000
WO 2006/066405 A1 6/2006

OTHER PUBLICATIONS

PCT International Search Report and Written Opinion for PCT/IB2015/059329 filed on Dec. 3, 2015 in the name of O.M.P. Officine Mazzocco Pagnoni S.R.L dated Mar. 21, 2016.

*Primary Examiner* — Theresa Trieu
(74) *Attorney, Agent, or Firm* — Steinfl + Bruno LLP

(57) ABSTRACT

A variable displacement oil pump is described. The oil pump has a pump body connected to an intake channel and to a delivery channel, a rotor capable of rotating inside the pump body about a rotation axis and provided with a plurality of vanes. The oil pump has an oscillating stator arranged in an eccentric position around the rotor and pivoted inside the pump body at a rotation pin. The oil pump has adjustment means for adjusting the displacement of the oil pump which acts on the oscillating stator to displace it with respect to the rotor and position it in at least one predetermined operative position. The adjustment means has first thrusting means configured to exert a first thrusting action on a first outer
(Continued)

surface portion of the oscillating stator arranged on a substantially opposite side with respect to the rotation pin taking as a reference the rotor.

7 Claims, 3 Drawing Sheets

(51) Int. Cl.

| | |
|---|---|
| ***F04C 14/18*** | (2006.01) |
| ***F04C 14/22*** | (2006.01) |
| ***F04C 2/344*** | (2006.01) |
| ***F04C 15/00*** | (2006.01) |
| ***F01C 21/10*** | (2006.01) |

(52) U.S. Cl.
CPC .... *F04C 15/0003* (2013.01); *F04C 2210/206* (2013.01); *F04C 2240/10* (2013.01); *F04C 2240/30* (2013.01)

(58) Field of Classification Search
CPC ..... F04C 2210/206; F04C 2240/10; F04C 2240/20; F04C 2240/30; F01C 21/106; F01C 21/0836
USPC ..... 418/24, 26–28, 30–31, 259; 417/220, 417/218, 310
See application file for complete search history.

(56) References Cited

U.S. PATENT DOCUMENTS

| | | | | |
|---|---|---|---|---|
| 2009/0269234 | A1* | 10/2009 | Hedrich, Jr. ..... | F04C 14/226 418/30 |
| 2011/0293458 | A1* | 12/2011 | Schmidt ..... | F04C 14/226 418/30 |
| 2013/0195705 | A1 | 8/2013 | Williamson et al. | |
| 2014/0199197 | A1 | 7/2014 | Bowing et al. | |

* cited by examiner

VARIABLE DISPLACEMENT OIL PUMP

CROSS REFERENCE TO RELATED APPLICATIONS

The present application is the U.S. national stage of International Patent Application PCT/IB2015/059329 filed internationally on Dec. 3, 2015, which, in turn, claims priority to Italian Patent Application No. MI2014A002090 filed on Dec. 5, 2014.

SUMMARY

The present invention relates to a variable displacement oil pump.

BACKGROUND

The oil pump of the invention has a preferred application in engines for automobiles.

As known, engines for automobiles typically comprise an oil pump configured to pump pressurised oil to lubricate the engine.

FIG. 1 shows a variable displacement oil pump of the prior art, which is wholly indicated with 10. The oil pump 10 comprises a pump body 12 connected to an intake channel 12*a* and to a delivery channel 12*b*, a rotor 14 capable of rotating inside the pump body 12 about a rotation axis and an oscillating stator 22 arranged in an eccentric position around the rotor 14 and capable of moving inside the pump body 12 about a rotation pin 23. The rotor 14 is provided with radial cavities 16 inside which vanes 18 slide, the radially outer ends 20 of vanes 18 contacting the inner surface 21 of the oscillating stator 22 (for the sake of clarity of illustration reference numerals 16, 18 and 22 are associated with only one of the radial cavities and with only one of the vanes shown). The vanes 18, the oscillating stator 22 and the rotor 14 define inside the pump body 12 a plurality of chambers 24 (for the sake of clarity of illustration reference numeral 24 is associated with only one of the chambers shown). Oil is fed into the chambers 24 from the intake channel 12*a*. Such oil is pressurised due to the decrease of the volume of the chambers 24 upon rotation of the rotor 14. The pressurised oil is then fed through the delivery channel 12*b* to the parts of the engine that need to be lubricated.

The displacement of the oil pump 10 is determined by the eccentricity between oscillating stator 22 and rotor 14. Therefore, a variation of the aforementioned eccentricity leads to a variation in the displacement of the oil pump.

The eccentricity between rotor and oscillating stator is determined by the balance between the thrusting action exerted on the oscillating stator 22 by a pressurised fluid (typically oil) fed inside a thrusting chamber 28 defined between the pump body 12 and the oscillating stator 22 and the thrusting action exerted on the oscillating stator 22 by a helical spring 30.

The thrusting chamber 28 is delimited on one side by the rotation pin 23 and, on the opposite side, by a gasket 32.

The Applicant has found that in oil pumps of the type described above there can be, at the rotation pin, leakages of the pressurised oil present inside the thrusting chamber. This is due to the fact that, in order to be able to obtain frictionless movement of the oscillating stator with respect to the rotor, the rotation pin is mounted with clearance in the respective housing seats provided in the oscillating stator and in the pump body. A possible oil leakage at the rotation pin causes the oil pump to malfunction or in any case to operate differently from what is provided for at the design stage. In particular, the oil pump is not able to ensure the flow rate for which it was designed.

The technical problem at the basis of the present invention is to avoid possible oil leakages at the rotation pin of the oscillating stator.

The present invention therefore relates to a variable displacement oil pump in accordance with claim 1.

In particular, the oil pump of the invention comprises a pump body connected to an intake channel and to a delivery channel, a rotor able to rotate inside the pump body about a rotation axis and provided with a plurality of vanes, an oscillating stator arranged in an eccentric position around the rotor and pivoted inside the pump body at a rotation pin, and adjustment means for adjusting the displacement of the oil pump acting on the oscillating stator to displace it with respect to the rotor and position it in at least one predetermined operative position, wherein said adjustment means comprise first thrusting means configured to exert a first thrusting action on a first outer surface portion of the oscillating stator arranged on a substantially opposite side with respect to the rotation pin, and a thrusting chamber defined between the pump body and a second outer surface portion of the oscillating stator arranged between the rotation pin and said first outer surface portion, said thrusting chamber being configured to be filled with a predetermined amount of a pressurised fluid to exert on the oscillating stator a second thrusting action opposite to said first thrusting action and suitable for displacing the oscillating stator to take it into said at least one predetermined operative position, characterised in that the thrusting chamber is defined between two opposite sealing gaskets so as to be fluid-dynamically insulated from the rotation pin and in that it comprises an insulation chamber arranged between said at least one thrusting chamber and the rotation pin and connected to an intake conduit.

Throughout the present description and in the subsequent claims, the expression "fluid-dynamically insulated" is used, with reference to the thrusting chamber, to indicate a condition in which passage of fluid from inside the thrusting chamber towards the outside of the thrusting chamber is substantially prevented.

Throughout the present description and in the subsequent claims, the expression "intake conduit" is used to indicate an area having a pressure lower than that of the insulation chamber, that is suitable for allowing a flow of fluid from the insulation chamber towards such an area.

Advantageously, in the oil pump of the invention the aforementioned sealing gaskets and the suction action which the insulation chamber is subjected to keep the rotation pin insulated from the pressurised fluid fed outside of the oscillating stator, thus avoiding possible leakages of the aforementioned pressurised fluid at the rotation pin.

Advantageously, pressurised fluid is not fed into the insulation chamber. Such an insulation chamber acts both as a structural separation chamber between thrusting chamber and rotation pin and as collection chamber of possible fluid that leakages from the thrusting chamber towards the insulation chamber (due, for example, to damage to a sealing gasket of the thrusting chamber). Such a possible fluid is, however, evacuated from the insulation chamber by suction, preventing it from being able to directly reach the rotation pin.

Preferred features of the variable displacement oil pump according to the invention are recited in the dependent claims. The features of each dependent claim can be used individually or in combination with those recited in the other dependent claims.

Preferably, the intake conduit is connected to the intake channel of the pump.

Alternatively, the intake conduit is connected to a distinct suction pump, or to an area located outside of the pump body and having a pressure lower than that of the insulation chamber.

Preferably, the insulation chamber is defined between the rotation pin and a first gasket of said at least two opposite sealing gaskets and said at least one thrusting chamber is defined between the first gasket and at least one second gasket of said at least two opposite sealing gaskets. The possibility that the pressurised fluid which is in the thrusting chamber leaks into the insulation chamber is thus very remote due to the fact that such chambers are fluid-dynamically insulated from one another by a sealing gasket.

Preferably, the first gasket is angularly spaced from the rotation pin by an angle lower than 90° with reference to said rotation axis.

Preferably, the second gasket is angularly spaced from the first gasket by an angle greater than 90° with reference to said rotation axis.

In further embodiments of the oil pump of the present invention, said at least one thrusting chamber comprises a first thrusting chamber arranged between the first gasket and a further sealing gasket arranged between the first gasket and the second gasket, and at least one second thrusting chamber arranged between said further gasket and the second gasket, wherein said first and second thrusting chambers are each configured to be filled, simultaneously or alternatively, with a respective predetermined amount of pressurised fluid.

Preferably, said at least two opposite sealing gaskets are housed in respective seats formed in the oscillating stator.

In an alternative embodiment of the oil pump of the invention, one of said two opposite sealing gaskets is arranged at the rotation pin. In such an embodiment therefore, it is not provided any insulation chamber or any structural separation between rotation pin and thrusting chamber. In this case, leakage of the pressurised fluid at the rotation pin is prevented by the fact that a sealing gasket is arranged in the housing seat of the rotation pin.

Preferably, in all of the aforementioned embodiments, the aforementioned first thrusting means comprises an elastic element, more preferably a helical compression spring. Alternatively, the aforementioned first thrusting means can comprise a thrusting chamber filled by a pressurised fluid.

BRIEF DESCRIPTION OF THE DRAWINGS

Further characteristics and advantages of the present invention will become clearer from the following detailed description of a preferred embodiment thereof, made with reference to the attached drawings and given for indicating and not limiting purposes. In such drawings.

DETAILED DESCRIPTION

Figure 1:
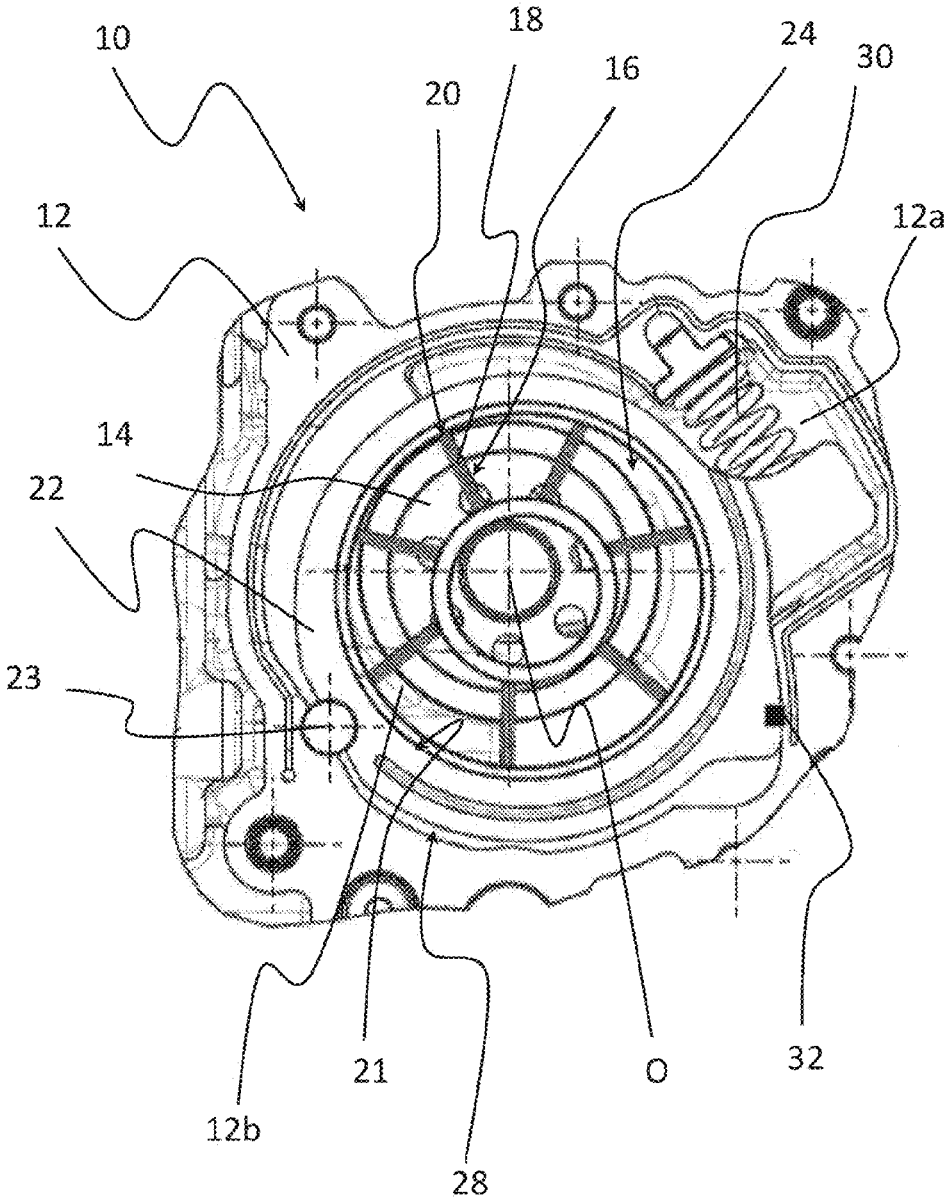
FIG. 1 (PRIOR ART)
FIG. 1 schematically shows a cross section of a variable displacement oil pump made according to the prior art and described above.
Figure 2:
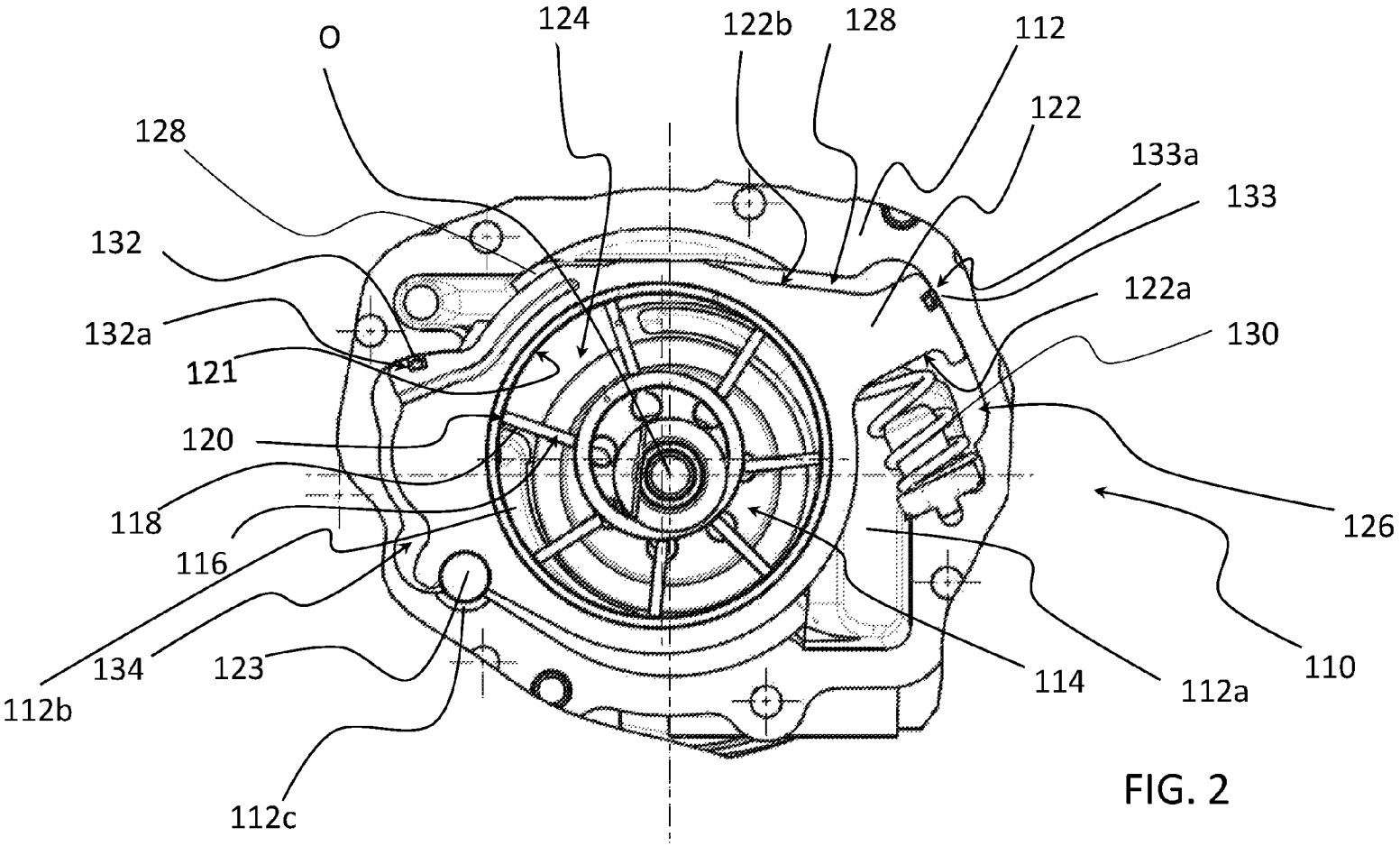
FIG. 2 schematically shows a cross section of a variable displacement oil pump made according to the invention.

With reference to FIG. 2, a variable displacement oil pump in accordance with the present invention is shown. Such an oil pump is indicated with 110.

The oil pump 110 is suitable for being used in an automobile engine.

The pump 110 comprises a pump body 112 in which a rotor 114 rotates. The rotor 114 is provided with radial cavities 116 inside which vanes 118 slide. For the sake of clarity of illustration, reference numerals 116 and 118 are associated with only one of the radial cavities and with only one of the vanes shown.

The pump body 112 is connected to an intake channel 112*a* and to a delivery channel 112*b*.

The radially outer ends 120 of the vanes 118 contact the inner surface 121 of an oscillating stator 122 arranged in an eccentric position around the rotor 114. The vanes 118, the oscillating stator 122 and the rotor 114 define a plurality of chambers 124 inside the pump body 112. For the sake of clarity of illustration, reference numeral 124 is associated with only one of the chambers shown.

During the rotation of the rotor 114 the volume inside the chambers 124 in which oil has been fed by the intake channel 112*a* reduces, obtaining an increase in pressure of the oil until each chamber 124 reaches the delivery channel 112*b*, through which the pressurised oil is fed to the engine.

The oscillating stator 122 is pivoted inside the pump body 112 at a rotation pin 123 and is able to move with respect to the rotor 114 between a first position in which the eccentricity between rotation axis O of the rotor 114 and centre of the oscillating stator 122 is at the minimum and a second position in which the eccentricity between rotation axis O of the rotor 114 and centre of the oscillating stator 122 is at the maximum (in FIG. 2 a condition of maximum eccentricity is shown). The aforementioned variation in eccentricity determines a variation of the volume of the chambers 124 and, consequently, a variation of the flow rate (or displacement) of the oil pump 110.

The rotation pin 123 can be integrated in the oscillating stator 122 and housed in a seat formed in the pump body 112, or alternatively it can be integrated in the pump body 112 and housed in a seat formed in the oscillating stator 122, or alternatively it can be a distinct element from the pump body 112 and from the oscillating stator 122 and housed in seats formed on the pump body 112 and the oscillating stator 122.

The oil pump 110 comprises a helical spring 130, of the compression type, which is associated, at a first free end thereof, with the pump body 112 and which exerts a pushing action, at the opposite free end thereof, on a first outer surface portion 122*a* of the oscillating stator 122 arranged on the opposite side to the rotation pin 123 with reference to the rotor 114.

The oil pump 110 further comprises a thrusting chamber 128 defined between the pump body 112 and a second outer surface portion 122*b* of the oscillating stator 122. Such a thrusting chamber 128 is connected to the intake channel 112*a* and is delimited by two opposite sealing gaskets 132, 133 housed in respective seats 132*a*, 133*a* formed on the oscillating stator 122.

The eccentricity between rotation axis O of the rotor 114 and centre of the oscillating stator 122 is determined by the balance between the thrusting action exerted by the helical spring 130 on the first outer surface portion 122*a* of the oscillating stator 122 and the opposite thrusting action exerted on the second outer surface portion 122*b* of the oscillating stator 122 by a predetermined amount of pressurised fluid (typically oil) fed into the thrusting chamber 128.

Both of the gaskets 132, 133 are arranged between the rotation pin 123 and the aforementioned first outer surface portion 122*a* of the oscillating stator 122, the gasket 132 being closer to the rotation pin 123 and the gasket 133 being closer to the helical spring 130. The aforementioned gaskets 132, 133 ensure that the thrusting chamber 128 is fluid-dynamically insulated with respect to the rotation pin 123.

An insulation chamber 134 is arranged between the rotation pin 123 and the thrusting chamber 128. Such an insulation chamber 134 thus structurally separates the thrusting chamber 128 from the rotation pin 123, preventing undesired leakages of the pressurised fluid present in the thrusting chamber 128 to occur at the rotation pin 123.

The insulation chamber 134 is thus defined between the rotation pin 123 and the gasket 132.

The gasket 132 is angularly spaced from the rotation pin 123 by an angle lower than 90° with reference to the rotation axis O of the rotor 114, whereas the gasket 133 is angularly spaced from the gasket 132 by an angle greater than 90° with reference to the aforementioned rotation axis O.

The fluid-dynamic insulation of the rotation pin 123 from the thrusting chamber 128 is ensured, also in the case of leakage of pressurised oil from the thrusting chamber 128 into the insulation chamber 134, by the fact that the insulation chamber 134 is connected to the intake conduit 112*c*, which ensures the evacuation by suction of possible pressurised oil present in the insulation chamber 134.

Preferably, the intake conduit 112*c* is connected to the suction channel of the pump 100.

Alternatively, the intake conduit 112*c* is connected to a distinct suction pump.

Alternatively, the intake conduit 112*c* is connected to the outside of the pump body 112 or at an area having a pressure lower than that of the insulation chamber 134.

The helical spring 130 and the thrusting chamber 128, when filled with pressurised fluid, define adjustment means 126 for adjusting the eccentricity between rotation axis O of the rotor 114 and centre of the oscillating stator 122, i.e. adjustment means 126 for adjusting the displacement of the oil pump 110.

In operation, a predetermined amount of a pressurised fluid is fed into the thrusting chamber 128 to move the oscillating stator 122 with respect to the rotor 114, overcoming the thrusting action exerted by the helical spring 130, and to position the oscillating stator 122 in a predetermined operative position defined as a function of the required displacement or flow rate. A change in the amount of fluid fed into the thrusting chamber 128 produces a change in the eccentricity between centre of the oscillating stator 122 and rotation axis O of the rotor 114 and, therefore, a change in the displacement or flow rate of the oil pump 110. Oil is fed into the chambers 124, said oil being pressurised as a consequence of the decrease of the volume of the chambers 124 upon rotation of the rotor 114. The pressurised oil is then fed to the parts of the engine that need to be lubricated.

In order to satisfy specific and contingent requirements, those skilled in the art can bring numerous modifications and changes to the oil pump 110 described above with reference to FIG. 2, all of these modifications and changes being in any case covered by the scope of protection of the present invention as defined by the following claims.

For example, in some solutions (not shown) it is possible to foresee two or more thrusting chambers, a first thrusting chamber being structurally separated from the rotation pin 123 by the aforementioned insulation chamber 134 and the other thrusting chamber(s) being arranged, with reference to the aforementioned first thrusting chamber, on the opposite side to the insulation chamber 134.

It is also possible to foresee further solutions (also not shown) in which the aforementioned insulation chamber 134 is positioned on the opposite side to the thrusting chamber 128, taking the rotation pin 123 as reference, or in which the insulation chamber 134 houses the rotation pin 123, or in which the insulation chamber 134 is not present. In this last case, the thrusting chamber 128 (or one of the two or more thrusting chambers possibly foreseen) is adjacent to the rotation pin 123 and, in order to avoid fluid leakage at the rotation pin 123, the latter is insulated from the aforementioned thrusting chamber 128 through a suitable sealing gasket.

Figure 3:
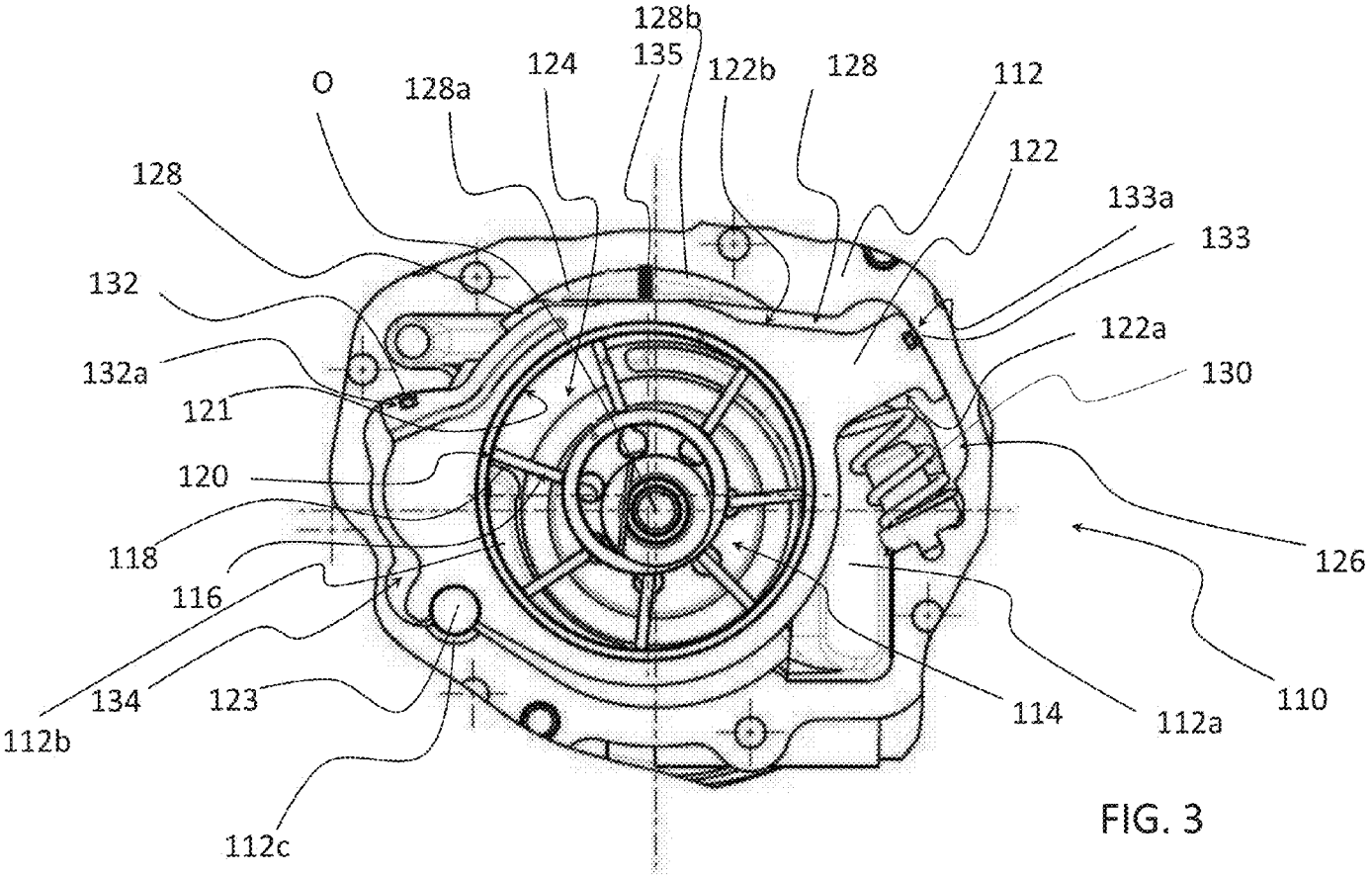
FIG. 3 schematically shows a cross section of a variable displacement oil pump having two thrusting chambers and an additional gasket.

As illustrated in FIG. 3, in some embodiments the thrusting chamber comprises a first thrusting chamber 128*a* arranged between the first gasket and a further sealing gasket 135 arranged between the first gasket and the second gasket. The thrusting chamber also comprises a second thrusting chamber 128*b* arranged between said further sealing gasket 135 and the second gasket, and said first and second thrusting chambers 128*a*, 128*b* are each configured to be filled, simultaneously or alternatively, with a respective predetermined amount of pressurised fluid.

The invention claimed is:

1. A variable displacement oil pump, comprising:

a pump body connected to an intake channel and to a delivery channel, a rotor rotating inside the pump body about a rotation axis and provided with a plurality of vanes, an oscillating stator arranged in an eccentric position around the rotor and pivoted inside the pump body at a rotation pin, and adjustment means which adjust the displacement of the oil pump and act on the oscillating stator to displace it with respect to the rotor and position it in at least one predetermined operative position, wherein said adjustment means comprise:

first thrusting means exerting a first thrusting action on a first outer surface portion of the oscillating stator arranged on an opposite side with respect to the rotation pin taking as a reference the rotor, and at least one thrusting chamber defined between the pump body and a second outer surface portion of the oscillating stator arranged between the rotation pin and said first outer surface portion, said at least one thrusting chamber being filled with a predetermined amount of a pressurised fluid to exert on the oscillating stator a second thrusting action opposite to said first thrusting action so as to bring the oscillating stator to said at least one predetermined operative position, wherein said at least one thrusting chamber is fluid-dynamically insulated with respect to the rotation pin by two opposite sealing gaskets, and wherein said oil pump comprises an insulation chamber arranged between said at least one thrusting chamber and the rotation pin and connected to an intake conduit having a pressure lower than a pressure of the insulating chamber so as to prevent the pressurised fluid from directly reaching the rotation pin.

2. The oil pump according to claim 1, wherein said intake conduit is connected to said intake channel.

3. The oil pump according to claim 1,
wherein
the insulation chamber is defined between the rotation pin and a first gasket of said two opposite sealing gaskets, and
said at least one thrusting chamber is defined between the first gasket and a second gasket of said two opposite sealing gaskets.

4. The oil pump according to claim 3, wherein said first gasket is angularly spaced from the rotation pin by an angle lower than 90° with respect to said rotation axis.

5. The oil pump according to claim 3, wherein said second gasket is angularly spaced from the first gasket by an angle greater than 90° with respect to said rotation axis.

6. The oil pump according to claim 1, wherein said at least two opposite sealing gaskets are housed in respective seats formed in the oscillating stator.

7. A variable displacement oil pump, comprising:
a pump body connected to an intake channel and to a delivery channel,
a rotor rotating inside the pump body about a rotation axis and provided with a plurality of vanes,
an oscillating stator arranged in an eccentric position around the rotor and pivoted inside the pump body at a rotation pin, and
adjustment means which adjust the displacement of the oil pump and act on the oscillating stator to displace it with respect to the rotor and position it in at least one predetermined operative position,
wherein said adjustment means comprise:
first thrusting means exerting a first thrusting action on a first outer surface portion of the oscillating stator arranged on an opposite side with respect to the rotation pin taking as a reference the rotor, and
at least one thrusting chamber defined between the pump body and a second outer surface portion of the oscillating stator arranged between the rotation pin and said first outer surface portion,
said at least one thrusting chamber being filled with a predetermined amount of a pressurised fluid to exert on the oscillating stator a second thrusting action opposite to said first thrusting action so as to bring the oscillating stator to said at least one predetermined operative position,
wherein said at least one thrusting chamber is fluid-dynamically insulated with respect to the rotation pin by two opposite sealing gaskets, and
wherein said oil pump comprises an insulation chamber arranged between said at least one thrusting chamber and the rotation pin and connected to an intake conduit,
wherein:
the insulation chamber is defined between the rotation pin and a first gasket of said two opposite sealing gaskets,
said at least one thrusting chamber is defined between the first gasket and a second gasket of said two opposite sealing gaskets,
said at least one thrusting chamber comprises:
a first thrusting chamber arranged between the first gasket and a further sealing gasket arranged between the first gasket and the second gasket,
at least one second thrusting chamber arranged between said further sealing gasket and the second gasket, and
said first and second thrusting chambers are each configured to be filled, simultaneously or alternatively, with a respective predetermined amount of pressurised fluid.

* * * * *